US009320119B2

(12) United States Patent
Lochmann et al.

(10) Patent No.: US 9,320,119 B2
(45) Date of Patent: Apr. 19, 2016

(54) SYSTEM-VOLTAGE TRANSMISSION BRANCH OF AN INTERFACE OF AN OPERATING DEVICE FOR LIGHT-EMITTING MEANS

(75) Inventors: Frank Lochmann, Esseratsweiler (DE); Karlheinz Fenkart, Hohenems (AT); Markus Kostner, Dornbirn (AT)

(73) Assignee: Tridonic GmbH Co. KG, Dombirn (AT)

( * ) Notice: Subject to any disclaimer, the term of this patent is extended or adjusted under 35 U.S.C. 154(b) by 776 days.

(21) Appl. No.: 13/637,169

(22) PCT Filed: Mar. 30, 2011

(86) PCT No.: PCT/EP2011/054889

§ 371 (c)(1), (2), (4) Date: Nov. 13, 2012

(87) PCT Pub. No.: WO2011/121011

PCT Pub. Date: Oct. 6, 2011

(65) Prior Publication Data

US 2013/0043805 A1 Feb. 21, 2013

(30) Foreign Application Priority Data

Apr. 1, 2010 (DE) ..... 10 2010 003 597

(51) Int. Cl.
*H05B 41/24* (2006.01)
*H05B 37/02* (2006.01)

(52) U.S. Cl.
CPC ..... *H05B 37/0254* (2013.01); *H05B 37/0263* (2013.01)

(58) Field of Classification Search
USPC ..... 315/250, 214, 291, 295
See application file for complete search history.

(56) References Cited

U.S. PATENT DOCUMENTS

| | | | | |
|---|---|---|---|---|
| 8,427,074 | B1 * | 4/2013 | Xiong et al. | 315/307 |
| 2003/0030384 | A1 * | 2/2003 | Huber et al. | 315/291 |
| 2004/0227472 | A1 * | 11/2004 | Gaus et al. | 315/314 |

FOREIGN PATENT DOCUMENTS

WO 2009100762 A1 8/2009

OTHER PUBLICATIONS

International Search Report issued in connection with the corresponding International Application No. PCT/EP2011/054889 on Jul. 18, 2011.

* cited by examiner

*Primary Examiner* — Douglas W Owens
*Assistant Examiner* — James H Cho
(74) *Attorney, Agent, or Firm* — The H.T. Than Law Group

(57) ABSTRACT

What is proposed is: an operating device for operating in particular a light-emitting means (12), having: —supply terminals (16, 17) for connecting the operating device to a supply voltage provided by a supply source (20), —output terminals (10) for controlling the light-emitting means (12), —an interface (21) for connection to a bus (2), and—a transmission path which is coupled to the interface (21), wherein the transmission path is designed to connect the received supply voltage to the bus (2) selectively.

21 Claims, 4 Drawing Sheets

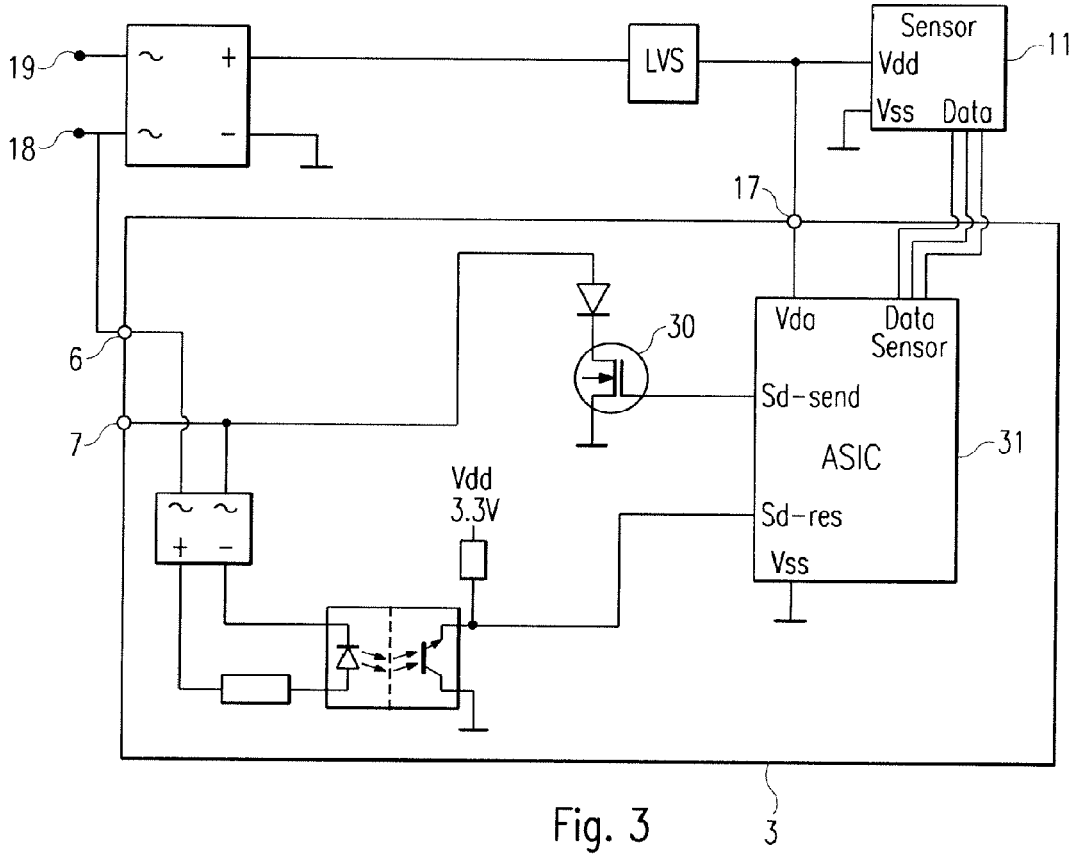
Fig. 3
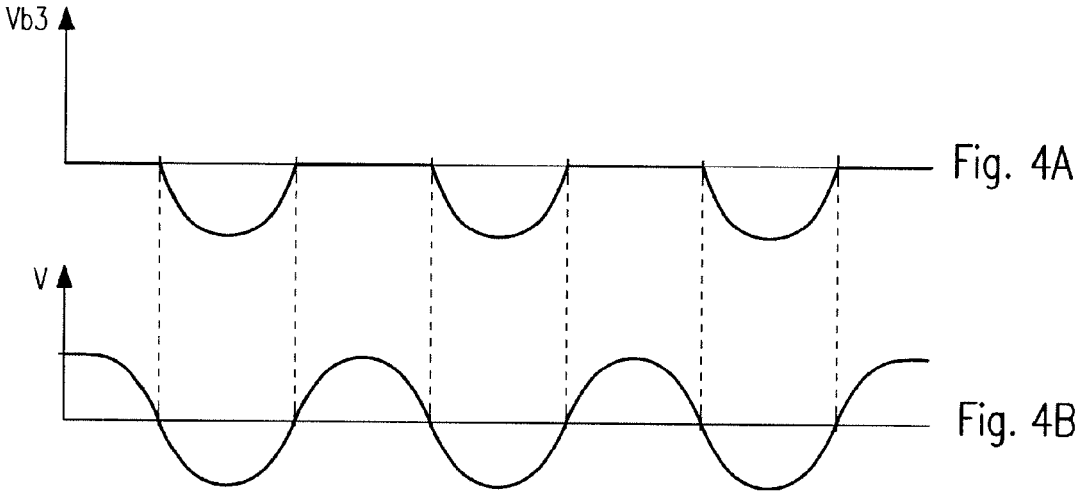
Fig. 4A
Fig. 4B

SYSTEM-VOLTAGE TRANSMISSION BRANCH OF AN INTERFACE OF AN OPERATING DEVICE FOR LIGHT-EMITTING MEANS

BACKGROUND OF THE INVENTION

The present invention relates to the transmission of data or energy based on an operating device for light-emitting means, particularly to a method and a device and to a system for data and/or energy transmission in the field of building technology, particularly of illumination technology.

As an example of a data transmission in the field of operating devices for light-emitting means, an operating device for electrical lamps is known from WO 0152607 A1, which device has a control signal input via which the operating device receives digital control signals for controlling the electrical lamps. At the same time, it is provided that analog control signals can also activate the operation of the lamps and of the operating device via the same control signal input.

The transmission of data via the power system is also known. In this technology, also called Power Line Communication (PLC), the carrier frequency of the system voltage is modulated with a radio-frequency signal. Devices which are connected to the power system within a building can thus send data by modulation via the power lines run in the building or, respectively, receive signals based on other devices by corresponding demodulation.

The present invention is then based on the object of specifying an alternative system, or a system for transmitting optionally data or energy which is particularly suitable for building technology devices.

SUMMARY OF THE INVENTION

In this context, the central concept is to provide an interface of an operating device for light-emitting means with a system voltage transmission branch which connects a system voltage selectively to a bus to a further operating device. Thus, a data and energy transmission can take place, wherein the protocol of the data transmission has the states "system voltage on" and "system voltage off", the presence, number and/or duration of which can be evaluated at the receiving end by the further operating device. On the other hand, the protocol provides preferably, and thus in contrast, e.g., to PLC, no modulation of a system voltage wave.

According to the present invention, it is provided that an operating device for light-emitting means, particularly an electronic ballast, can send out signals via an interface which has at least one transmission branch. In this arrangement, the signals are sent out in such a manner that a system voltage supplied to the interface separately (i.e. via a further input of the operating device) is connected to the bus selectively, for example over a predetermined period of time. The system voltage is connected to the aforementioned bus from a separately provided system voltage supply of the operating device. The electronic ballast or the operating device can thus send out signals to one or more other operating devices or other sensors or actuators in the building technology. These can evaluate the signals in that they evaluate, for example, the repetition rate of the system switching processes or their duration in time.

In contrast to Power Line Communication, it is not a higher-frequency signal which is modulated onto a passing system wave but the system voltage is selectively switched on and off. This selective switching of the system voltage can have, for example, a positive effect on the radiation of interfering frequencies.

The transmission branch of an interface of an operating device for light-emitting means can connect system voltage selectively to a bus line, wherein an evaluation in the sense of a data transmission or else only an evaluation as energy for a "wake-up phase" can be provided at the receiving end. A "wake-up phase" is usually the period needed by a control unit supplied with voltage for taking its own voltage supply into operation.

The possibility of rating the bus voltage generated by an electronic ballast either as data transmission and/or as energy supply is a further advantage of the present invention compared with the transmission possibilities known from the prior art.

The object of the present invention is achieved by the subject matter of the independent claims. Advantageous developments of the invention are the subject matter of the subclaims.

According to a first aspect of the present invention, an operating device for operating especially a light-emitting means is proposed wherein the operating device comprises:

- at least one supply terminal for connecting the operating device to a supply voltage provided by a supply source, especially a possibly rectified alternating voltage such as, e.g., a system voltage,
- output terminals for controlling an associated light-emitting means such as, e.g., at least one LED, OLED or gas discharge lamp,
- an interface for connection to a bus, and
- a transmission branch coupled to the interface, the transmission branch being designed for connecting the supplied supply voltage, preferably an AC voltage, selectively, i.e. with a timing predetermined by a control unit of the operating device, to the bus.

The signal transmission by means of the timed connection of the supply voltage to the bus and thus the coding of the bus signal can take place at a higher frequency than the frequency of the AC supply voltage.

The supply voltage is preferably connected to the bus for signal transmission.

The signal transmitted via the bus is coded by means of the duration in time of the connection of the supply voltage or of the number or of the frequency of connecting processes.

The supply voltage is connected to the bus preferably for supplying a further device or receiver connected to the bus with energy.

In this arrangement, the operating device can be configured as master and the further device or receiver as slave.

The supply voltage connected to the bus can be used as start-up energy of an active device or receiver, connected to the bus, which has a separate voltage supply.

The connected supply voltage can be used as start-up energy for a further operating device connected to the bus.

The supply voltage connected to the bus can be used as electrical supply of a passive device or receiver, connected to the bus, which does not have a separate voltage supply.

The passive device can be a sensor, particularly a brightness sensor or daylight sensor.

The interface can have a system-voltage-resistant switch for connecting the supply voltage to the bus.

The operating device can have preferably a reception branch coupled to the interface, wherein the reception branch is formed for evaluating a supply voltage connected to the bus.

The supply terminals can be designed for connecting a system voltage.

According to a further aspect of a present invention, a system having at least one operating device having a reception branch described above is proposed.

The system can have a switch or pushbutton which, when operated by a user, is designed for connecting a voltage, especially the supply voltage, selectively to the bus.

A further aspect of the invention relates to an illumination system having a number of operating devices for operating a light-emitting means, wherein the operating devices are in each case connected to a bus via an interface, and have at least one supply terminal for connecting the operating device to a supply voltage provided by a supply source, especially an alternating voltage such as, e.g., a system voltage, and output terminals for controlling the light-emitting means, wherein at least one operating device is connected to a sensor via terminals, and this operating device has a transmission branch coupled to the interface, wherein a control unit of the operating device switches the supplied and possibly rectified supply voltage timed to the bus line in order to send data to a further operating device, wherein the data are coded to be analog or digital by the timing of the connection of the supply voltage.

According to a further aspect of a present invention, a method is proposed for transmitting data or energy via a bus on the basis of an operating device for operating especially a light-emitting means towards a receiver, wherein the operating device is supplied by a supply voltage, the operating device connects this received supply voltage selectively to the bus via a transmission branch, the receiver evaluates the supply voltage, connected to the bus, via a reception branch.

In the text which follows, the subject matter of the invention will be explained in greater detail by means of preferred exemplary embodiments which are shown in the attached drawings.

BRIEF DESCRIPTION OF THE DRAWINGS

FIG. 3 is a diagrammatic representation of a ballast according to the present invention.

FIG. 4A shows a possible variation of the voltage on the bus and FIG. 4B shows the variation of the system voltage.

FIG. 1 shows a diagrammatic representation of an illumination system 1 according to a first exemplary embodiment of the present invention. The communication system 1 comprises three electronic ballasts 3, 4, 5 for operating light-emitting means 12, the ballasts being connected to a voltage supply system 2.

DETAILED DESCRIPTION OF THE INVENTION

Figure 1:
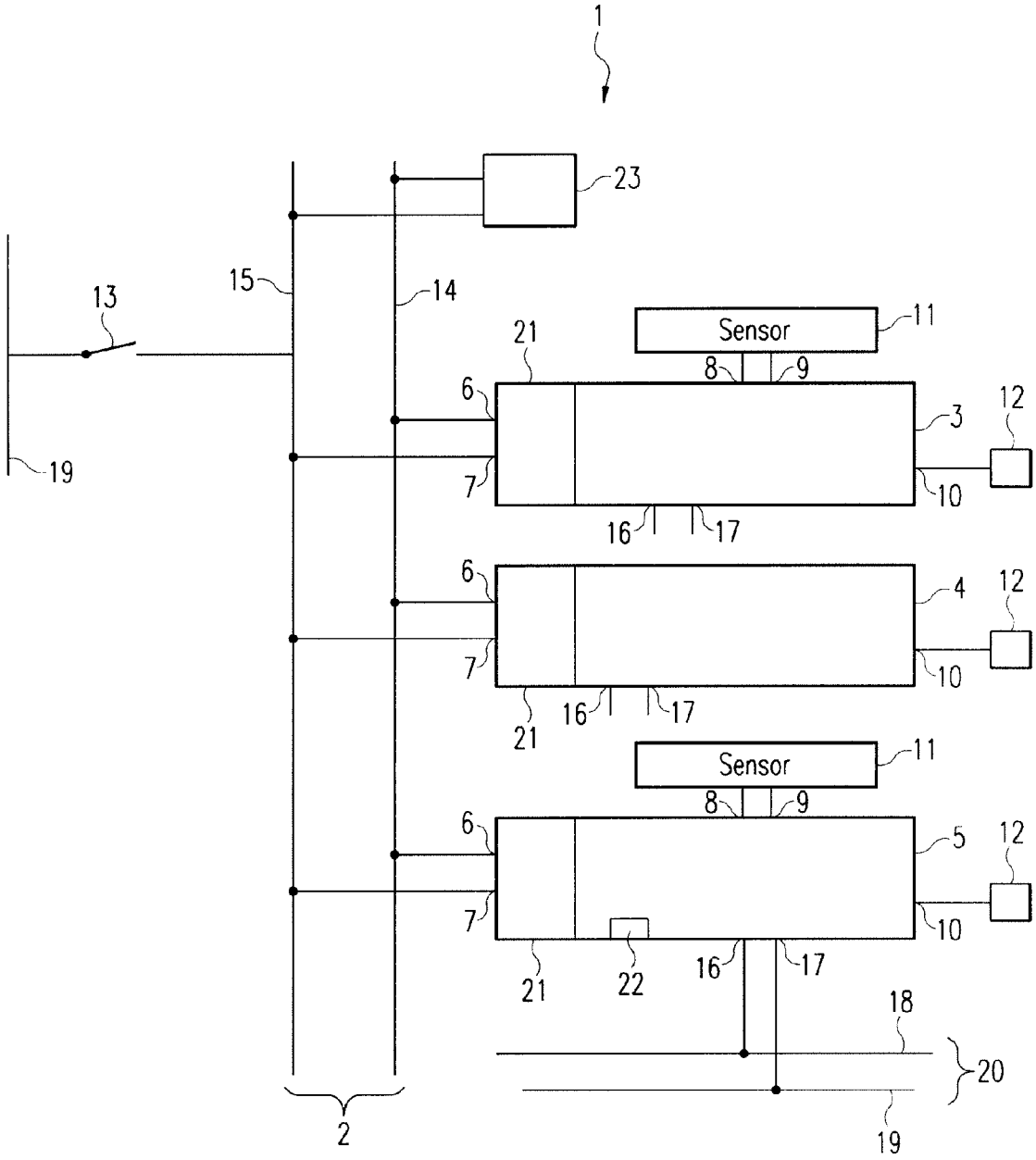
FIG. 1 shows a diagrammatic representation of an illumination system according to an exemplary embodiment of the present invention, comprising a number of operating devices with and without sensor systems, these operating devices being connected to one another via a communication bus.

The electronic ballasts 3, 4, 5 shown have in each case two terminals 6, 7 which are connected to a bus 2. Via this bus 2, data and/or energy can be transmitted between the ballasts 3, 4, 5 and further components connected thereto. A ballast 3, 4, 5 connected to the bus 2 has an interface 21 which has a transmission branch and/or a reception branch so that the electronic ballast 3, 4, 5 can send out and/or receive signals. The bus can comprise preferably two lines 14, 15, namely a neutral conductor 14 and one phase conductor 15. These designations refer to the fact that, according to the invention, as explained later in detail, an alternating voltage or a rectified version thereof, especially an alternating system voltage is connected selectively to these lines 14, 15. In principle the provision of one or two conductors to which a voltage can be connected is sufficient.

Each electronic ballast 3, 4, 5 also has two terminals 16, 17 which are connected to the neutral conductor 18 and to the phase conductor 19 of the alternating voltage source provided by the AC voltage supply system 20. As an alternative, it is also provided that the electronic ballasts 3, 4, 5 can also have a third terminal (not shown) in addition to the two terminals 16, 17, which three terminals can be connected correspondingly to ground, the phase 19 and to the neutral conductor 18 of a voltage supply.

In addition, the electronic ballasts 3, 4, 5 have control lines 10 for controlling a light-emitting means 12. The electronic ballasts 3, 5 additionally have preferably also an interface with two terminals 8, 9 for connection to a sensor 11, for example a brightness sensor or daylight sensor.

It has already been pointed out in the introduction that the electronic ballasts 3, 4, 5 in each case represent only an example of a building technology device, especially for an operating device for light-emitting means. The present invention can be applied to any light-emitting means. As light-emitting means, both electrical lamps such as, for example, incandescent lamps or gas discharge lamps and light-emitting diodes (LEDs, OLEDs) can be used.

Furthermore, a switch or pushbutton 13 is optionally connected to the lines 15 of the bus 2 in such a manner that an external voltage, especially a system voltage, can be applied to the bus phase conductor 15.

According to the present invention, it is provided that the electronic ballast 3, 4, 5 for light-emitting means can send out signals via the interface 21 which has at least one transmission branch, in that a system voltage supplied separately to the interface 21 is connected selectively to the bus 2 by a system-voltage-resistant switch of the interface 21. In this arrangement, the timing of the switch is predetermined by a control unit of the operating device so that the control unit can send out data generated or present internally in the operating device and externally supplied data to a further operating device.

This control unit can be an integrated circuit such as, e.g., an ASIC, microprocessor or a hybrid thereof.

The control unit can be a special control unit for controlling the transmission and possibly the reception operation of the interface. In this case, the control unit has a data connection to a further control unit which controls the operation of the light-emitting means.

As an alternative, this control unit can also control the operation of the light-emitting means. In this case, at least, the control unit will be connected to the system-voltage-resistant switch preferably by means of a potential isolation (optocoupler, transformer etc.).

The control unit is used for the digital or analog coded transmission and optionally also the reception of data. The data to be transmitted can be internally generated or present data such as, e.g., data with respect to optical (color, color temperature, light power, temperature, . . . ) or electrical parameters of the connected light-emitting means. Sending internal data is especially also suitable for setting a master/slave operation.

As an alternative or additionally, these data can also be externally supplied data which, e.g., have been supplied via a further interface and possibly also another protocol (e.g. DALI) to the operating device.

The data to be transmitted can also come from a sensor, e.g. a light sensor, color sensor or motion detector.

Connecting the supply voltage to the bus can be provided over a predetermined period of time. According to one embodiment of the invention, signals can be transmitted in accordance with an analog protocol. It is exemplary of such an analog protocol to evaluate the duration of the connection of the system voltage. The duration of the connection corresponds in this case to a predefined signal or control signal. As the connection period, a number of periods or half periods of the system current is preferably selected.

Figure 2A:
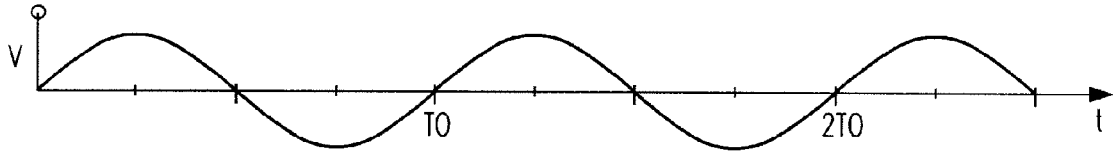
FIG. 2A shows the variation of the system voltage from the system supply network and FIGS. 2B and 2C show a possible variation of the voltage on the bus.
Figure 2B:
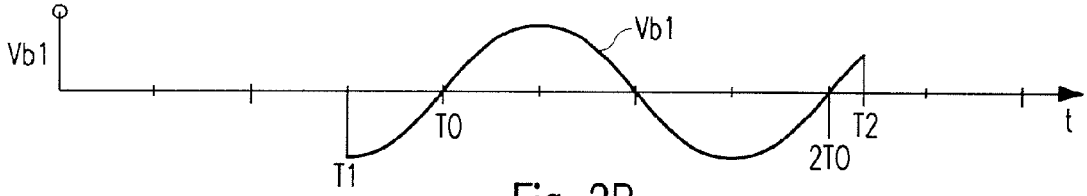
Figure 2C:
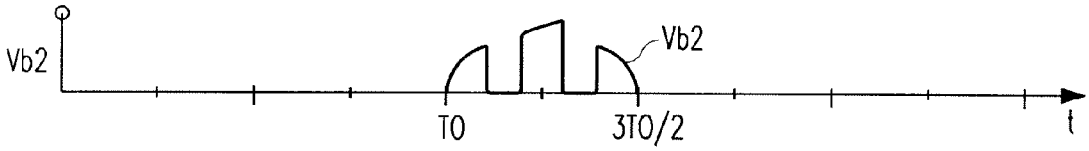

An example of such an analog signal transmission via the bus 2 will now be shown in conjunction with FIGS. 2A to 2C. The variation of the system voltage V from the system supply network 20 is shown in FIG. 2A. The system voltage V has a period T0.

FIG. 2B shows the variation of the voltage on the bus 2 or on the phase conductor 15, respectively. The bus voltage Vb=Vb1 is equal to zero up to time t=T1. At t=T1, a first electronic ballast 3 begins to connect the system voltage V received via the supply terminals 16, 17 to the bus lines 14, 15 of the bus. This is done by the ballast for a certain period of time T2-T1. This period of time is preferably greater than the period T0 of the system voltage V.

Further analog protocols can be based on the number of repetitions or on the repetition rate of a certain connection or connecting pattern. Thus, for example, it is shown in FIG. 2C that the supply voltage V of the power system 20 can be connected several times in succession for a short time. The bus voltage Vb=Vb2 shown in FIG. 2C and used for data communication is generated due to the fact that within a half period between t=T0 and t=3T0/2 the system voltage V is connected to the bus line of the bus three times in succession for a period of time t<T0/(2*3) which is shorter than the half period. With such a modulation, the number of repetitions or repetition rate of the connection, for example, is detected by a receiver and correspondingly evaluated.

The signal transmission by the timed connection of the supply voltage to the bus and thus the coding of the bus signal can take place at a higher frequency than the frequency of the AV supply voltage of the operating device.

For the signal transmission, the coding of the bus signal can also be defined via the time interval of connection (for example over a number of half waves of the supply voltage) or the number of connected half waves.

As an alternative or additionally, the connection/ disconnection of the supply voltage can of course also be used as respective edges of a digital bit.

Thus, a digital or an analog protocol can be implemented.

The bus voltages shown in FIGS. 2B and 2C show a connection of the system voltage within a period of time of T1 to T2 or from T0 to 3T0/2, respectively. Outside this period of time, the bus voltage is equal to zero or does not correspond to the system supply voltage V. The idle state of the bus 2 is then preferably a state where there is no system voltage. Receivers which are connected to the bus 2 evaluate the bus signal by evaluating, for example, the duration in time of a system connection process or of the system connection processes (FIG. 2B) or the number of system connection processes (FIG. 2C).

As an alternative, it is also provided that the idle state of the bus line 6, 7 of the bus is the applied system voltage V. In this case, the variation of the bus voltage shown in FIG. 2B has the appearance that the bus voltage Vb is equal to zero between t=T1 and t=T2. Outside this area, the bus voltage corresponds to the system voltage. A receiver then does not evaluate the duration of a system connection process but the duration of a system turn-off process. It is however of advantage for the electrical loading, and thus also the thermal loading especially of the switch of the interface 21 when it only needs to transmit for a short time and for the rest, the idle state is the unconnected system voltage.

The examples described in conjunction with FIGS. 2B and 2C, especially of the evaluation of the duration of the connection of the system voltage to the bus line of the bus or the evaluation of the number of progressive connection processes represent examples of an analog protocol. According to the invention, there is also provision to implement a digital protocol. For example, certain phases of the system voltage can be allocated to certain bits. In particular when such a digital protocol is present, the actual driving data can be provided with a type of header which reproduces the priority of the corresponding signals following. The header can contain additional info nation about the payload data themselves. It can also contain, for example, additional information or identification information about the ballast 3, 4, 5 which sends the signal via the bus 2.

According to a further embodiment of the invention, the bus 2 can also be provided for transmitting via a reception and/or transmission branch digital signals, which can also be used at the terminals 6, 7 of the interface 21, for example according to a protocol for illumination systems such as DALI (Digital Addressable Lighting Interface) standard. From the ballast 3, 4, 5, signals can be transmitted correspondingly in the form of a DC voltage with an amplitude which is much lower in comparison with the system voltage V (for example 12 volt maximum). In this arrangement, the said transmission branch, i.e. the switch of the transmission branch, is designed to be system-voltage-resistant. According to the invention, and in contrast to the DALI transmitting operation, the bus 2 is not selectively short-circuited but the system voltage V is selectively connected to the bus lines 14, 15 of the bus.

The operating device 3, 4, 5 can have, in addition to the said interface 21 for connection to the bus line 2 of the bus, further communication possibilities, especially a further interface 22 for, for example, digital protocols such as the DALI mentioned above or the DSI (Digital Serial Interface) protocol used to dim electronic ballasts.

According to a further embodiment of the invention, the system voltage connected selectively in the sense of the signal transmission can also be used as electrical energy by a receiver. This can be, for example, the electrical start-up energy for a ballast or also the electrical supply (possibly by using a buffer store such as a capacitor) for a sensor 23 which needs a voltage supply.

In order to enable transmitted data to be evaluated as start-up energy of a control unit (e.g. ASIC) of the receiver device, it can be provided that redundant data are transmitted, that is to say, e.g., pure wake-up signals or a multiple transmission of genuine data signals.

In this case, the selective connection of the system voltage by an operating device 3, 4, 5 is evaluated by a receiver not in the sense of a payload signal but only represents the necessary starting energy for the start-up phase of the receiver. In this sense, a receiver is a ballast 3, 4, 5 or a further unit connected to the bus 2 which can use the bus voltage via a reception branch. When this bus voltage Vb is used as electrical energy at the receiving end, the receiver does not need any special intelligence relating to the evaluation of the bus signal and especially relating to the number of repetitions, the repetition rate or the duration of the connected system voltage in time.

Instead, the system 1 is in this case a hierarchical master/slave system where at least one ballast 3, 4, 5, as master, provides electrical energy on the bus 2. The further units of the system (ballasts or sensors, for example) operate as slave and are dependent on the energy provided on the bus 2.

This start-up energy is typically the energy which is necessary for being able to start a low-voltage supply in an operating device 3, 4, 5, this low-voltage supply starting, for example, an integrated circuit such as an ASIC 31 or a microcontroller which then starts up (especially starts to operate its own voltage supply) and can control the operation of the operating device. Thus, there would be no actual data transmission but only the sending of a type of wake-up energy.

According to one scenario of the present invention, a ballast 3, 4, 5 is connected to a sensor which transmits data such as, for example, brightness data, to the ballast. The sensor 11 can be connected to the ballast 3, 4, 5 via the two terminals 8, 9 designed for this purpose. As an alternative, the sensor 23 can be connected to the ballast via the bus 2, wherein corresponding electrical energy is intended to then be provided possibly on the bus 2 if the sensor 23 itself does not have its own voltage supply. The operating device or ballast, respectively, can then drive further slave devices or slave sensors or slave actuators by means of the received sensor data via the said selective connection of the system voltage to the bus line 2 of the bus.

It is thus possible to build up a control system for an illumination where, for example, only one individual ballast is connected to a sensor 11. This ballast can evaluate the signals received from the sensor 11 and then adapt both its own operation correspondingly and also transmit corresponding data via the bus 2 to the further ballasts.

It is thus also possible that various types of sensors are connected to one ballast each. Thus, for example, a brightness sensor can be connected as sensor 11 to a first ballast 3 and a motion sensor can be connect to a further ballast 5 as sensor 11. In this case, the two ballasts 3 and 5 can communicate with one another via the bus 2. For example, the ballast 5 can detect a motion via its sensor 11 and inform the other ballasts correspondingly, especially the ballast 3 with the brightness sensor. Following the reception of these data, the ballast 3 can check the brightness at the sensor 11. If it is found that the current brightness does not correspond to the brightness specified for the case of a detected motion, the ballast 3 can then adapt the brightness of its connected light-emitting means correspondingly and/or initiate a corresponding change in brightness at the further ballasts 4, 5 connected to the bus 2 via corresponding bus signals.

In this case, the corresponding bus signals can be prioritized, for example, a prioritization of the bus signals can thus be carried out in dependence on the type or priority of the respectively sensor 11 connected. For example, the bus signals which are sent out by the ballast 5 can have a higher priority than the bus signals of the ballast 3.

The sensors 11 can be various types of sensors, for example also presence sensors, color sensors, artificial-light sensors, outside-light sensors, temperature sensors or receivers for infrared signals or radio signals.

Thus, an illumination system is provided for which has a number of operating devices 3, 4, 5 for operating a light-emitting means 12, wherein the operating devices 3, 4, 5 are in each case connected to a bus line 2 via an interface 21. The operating devices 3, 4, 5 have at least one supply terminal 16, 17 for connecting the operating device to a supply voltage provided by a supply source 20, especially an alternating voltage such as, e.g., a system voltage, and an output terminal 10 for controlling the light-emitting means 12. At least one operating device 3 is connected to a sensor 11 via terminals 8, 9 designed for this purpose. This operating device 3 has a transmission branch coupled to the interface 21, wherein a control unit of the operating device switches the supplied and possibly rectified supply voltage timed to the bus line 2, in order to send data to a further operating device, wherein the data are coded to be analog or digital by the timing of the connection of the supply voltage. These data are preferably dependent on the monitoring of the sensor 11.

The interface 21 is preferably designed to be bidirectional for connection to the bus line of the bus. I.e. each device which can transmit by selective connection of the system voltage to the bus 2 can correspondingly also evaluate in system-voltage-resistant manner such signals from the bus 2 and forward these with potential isolation to its own ASIC or other integrated circuits.

In an illumination system 1 according to the invention, which has at least one operating device 3, 4, 5 which, as described above, can selectively transmit data or at least energy by connection of system voltage V, switches or pushbuttons can also be provided which can trigger processes as a manual interface. One example of such a switch is the switch 13 shown in FIG. 1 by means of which a user can cause the selective connection of a system voltage. On switching the switch 13 on, the phase conductor 19 of the supply system is actually connected to the phase conductor 15 of the bus.

A typical bus voltage which is generated when operating the switch 13 is shown in FIG. 2B. The switch 13 is switched on by the user at t=T1 and released again at t=T2. Manual operation of the switch 13 generally leads to a number of several system voltage cycles being connected to the bus. In the bus signal of FIG. 2B, more than two half periods have been connected manually to the bus 2.

In this context, it is desirable to distinguish a manual application of a system voltage from an application triggered by a ballast 3, 4, 5. In order to discriminate a manual operation of the switch and thus a manual application from the signals sent out by an operating device, the protocol for the sending based on an operating device is preferably such that the system voltage is not applied continuously as in the case of manual operation.

For the transmission based on an operating device, coding can take place correspondingly via leading-edge phase control. Accordingly, no complete half waves are transmitted as when the pushbutton or switch is operated. An exemplary bus voltage which can result from this is shown in FIG. 2C. During one half wave of the system voltage, the application of the system voltage to the bus 2 is interrupted at least once. In the example of FIG. 2C, the application is interrupted even twice so that the half wave shown is not transmitted continuously.

As an alternative to the leading-edge phase control, a trailing-edge phase control or a combined leading-edge/ trailing-edge phase control or similar signal shapes are also possible, for example.

A receiver can then distinguish quite well between a bus voltage based on a user or on a ballast depending on whether the half waves of the bus voltage are continuous or interrupted or not. Accordingly, it is also possible to render the priority of a bus signal dependent on the type of application. A bus signal triggered by a user can be imparted a higher (or lower) priority than that of a bus signal based on an operating device.

Furthermore, a switch 30 in a ballast 3 can only pass positive or only negative half waves which represents leading-edge phase control coding and, on the other hand, also provides for switching at the zero transition. Such a switch 30 is shown in FIG. 3. FIG. 3 shows especially a ballast 3 with an ASIC 31 and a transmission branch coupled to the two bus terminals 6, 7.

Figure 5:
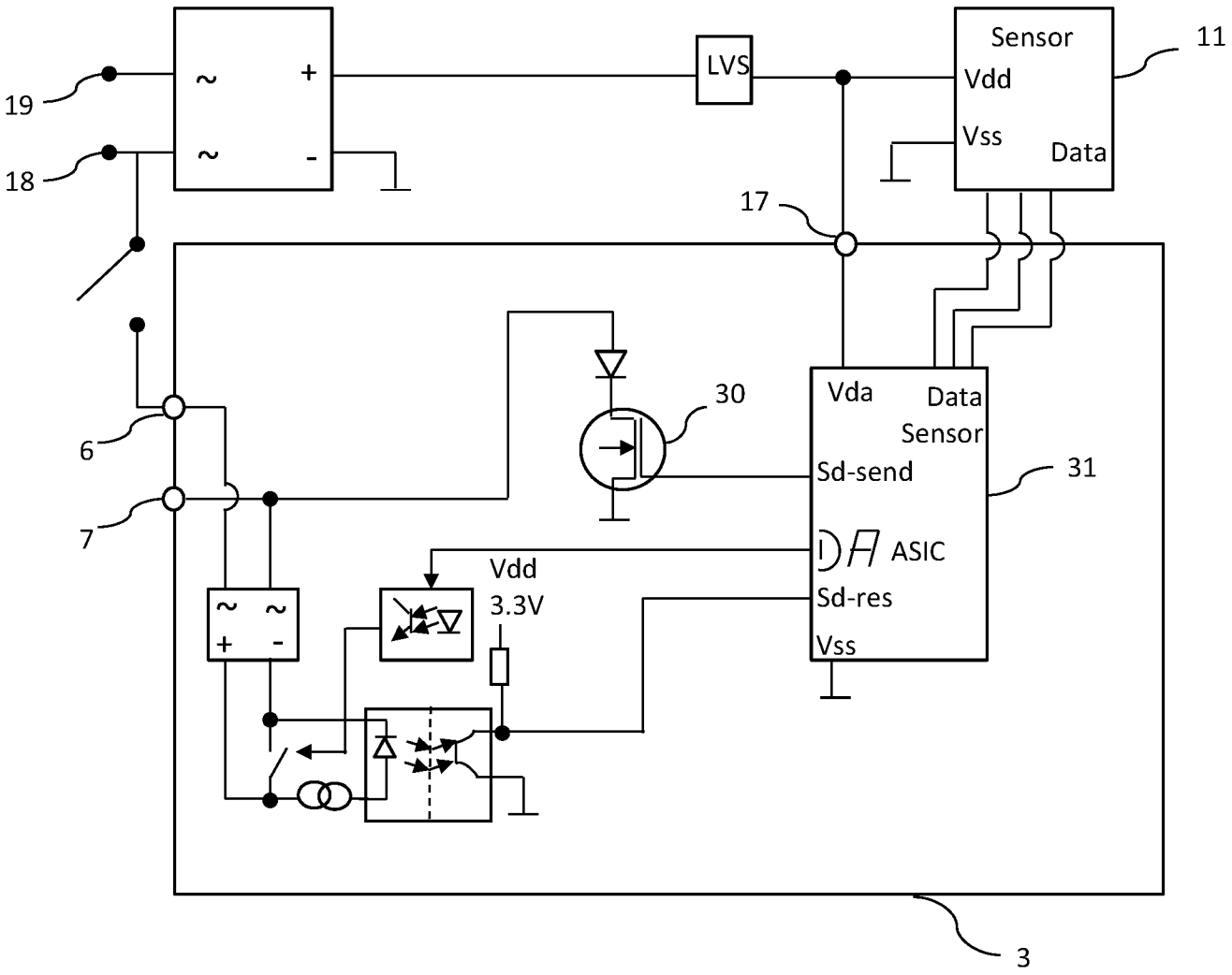
FIG. 5 is a diagrammatic representation of a ballast according to a further exemplary embodiment of the present invention.

As shown in FIG. 5, the interface 21 with the terminals 6 and 7 can also be designed for connection to a digital bus. Thus, the interface can be connected, for example, alternatively to a DALI-bus (according to the DALI protocol) and receive and evaluate digital signals. For this purpose, the interface can have a receiving and transmitting circuit for DALI commands behind the internal rectifier.

If the interface 21 is to be connected to a DALI bus, it is only necessary to interrupt, or not set the connection between the terminal for the neutral conductor 18 and the one input 6 of the bus terminal. The circuit variant shown in FIG. 5 shows a separate DALI return channel (driven via the output DA of the control circuit 31). However, it is also possible to design the interface circuit in such a manner that a common transmitting stage is provided for both the DALI transmitting operation and for the transmitting operation according to the invention by means of connection of the system voltage to the bus line 2.

As shown in FIG. 3, the neutral conductor 18 can be connected to one of the two terminals of the interface 21, for example to the bus terminal 6. Such a connection can take place outside the ballast or also inside the ballast. Preferably, this connection can be combined by the user or also interrupted, especially when the interface 21 is to be utilized only optionally for the terminal according to the invention and is possibly also to be able to be utilized for another data transmission (for example for a bus connection according to the DALI protocol). For example, there can be a detachable connection between the neutral conductor 18 to one of the two terminals of the interface 21, such as, for example, by means of a plug-in bridge, jumper or switch. If this connection exists, it is made possible that the electronic ballast 3, 4, 5 for light-emitting means can send out signals via the interface 21 in that a system voltage supplied separately to the interface 21 is connected (by means of this connection) selectively by a preferably system-voltage-resistant switch of the interface 21 to the bus 2. In this context, the timing of the switch is predetermined by a control unit of the operating device so that the control unit can send out data generated or present internally in the operating device and also data supplied externally to a further operating device. If there is a corresponding protective circuit, a system-voltage-resistant embodiment of the switch 30 can also be dispensed with.

Whereas FIG. 4B shows the variation of the system voltage V, FIG. 4A shows the voltage Vb3 which is connected to the bus 2 by the ballast 3 via the two bus terminals 6, 7. The system voltage is modulated in such a manner that only the positive half waves or only the negative half waves of the system voltage are connected. This modulation also allows discrimination between a connection of a system voltage based on a ballast and a continuous bus voltage generated by a user by operating a switch 13.

Furthermore, coding of the bus signal can take place, for example, via the length of the leading-edge phase control so that, for example, the length of the leading-edge phase control (phase angle difference) is utilized as dimming value specification. At the receiving end, a ballast can evaluate this signal and derive from it corresponding dimming commands for the light-emitting means to be driven by the ballast at the receiving end.

LIST OF REFERENCE DESIGNATIONS

1 Communication System
2 Bus
3, 4, 5 Electronic Ballasts
6, 7 Bus Terminals of the Electronic Ballast
8, 9 Terminals of the Electronic Ballast
10 Control Line
11 Sensor
12 Light-Emitting Means
13 Switch or Pushbutton
14 Bus Neutral Conductor
15 Bus Phase Conductor
16, 17 System Terminals of the Electronic Ballast
18 Neutral Conductor of the Supply System
19 Phase Conductor of the Supply System
20 Voltage Supply System
21 Interface for Connection to a Bus Line of the Bus
22 Further Interface for Digital Protocols
23 Slave Sensor
30 Switch
31 ASIC

The invention claimed is:

1. An operating device for operating especially a light-emitting means (12), comprising at least one supply terminal (16, 17) for connecting the operating device to a supply voltage provided by a supply source (20), output terminals (10) for controlling the light-emitting means (12), an interface (21) for connection to a bus (2), and a transmission branch coupled to the interface (21), wherein a control unit of the operating device switches the supplied supply voltage timed to the bus (2) in order to send data to a further operating device, wherein the data are coded to be analog or digital by the timing of the connection of the supply voltage.

2. The operating device as claimed in claim 1, wherein the supply voltage is connected to the bus (2) for signal transmission.

3. The operating device as claimed in claim 2, wherein the signal transmitted via the bus (2) is coded to be analog or digital by means of the duration in time of the connection of the supply voltage, the number or the frequency of connecting processes.

4. The operating device as claimed in claim 1, wherein the supply voltage is connected to the bus (2) for supplying a further device or receiver connected to the bus (2) with energy.

5. The operating device as claimed in claim 4, wherein the operating device is configured as master and the further device or receiver is configured as slave.

6. The operating device as claimed in claim 1, wherein the supply voltage connected to the bus (2) is used as start-up energy of an active device or receiver, connected to the bus (2), which has a separate voltage supply.

7. The operating device as claimed in claim 6, wherein the connected supply voltage is used as start-up energy for a further operating device connected to the bus (2).

8. The operating device as claimed in claim 1, wherein the supply voltage connected to the bus line (2) is used as electrical supply of a passive device or receiver, connected to the bus (2), which does not have a separate voltage supply.

9. The operating device as claimed in claim 8, wherein the passive device is a sensor, particularly a brightness sensor or daylight sensor.

10. The operating device as claimed in claim 1, wherein the interface (21) has a system-voltage-resistant switch for connecting the supply voltage to the bus (2).

11. The operating device as claimed in claim 1, having a reception branch coupled to the interface (21), wherein the reception branch is formed for evaluating a supply voltage connected to the bus (2).

12. A system having at least one operating device as claimed in claim 11, having said reception branch.

13. The system as claimed in claim 12, having a switch or pushbutton (13) which, when operated by a user, is designed for connecting a voltage, especially the supply voltage, selectively to the bus (2).

14. The operating device as claimed in claim 1, wherein the at least one supply terminal (16, 17) is designed for connecting a system voltage.

15. The operating device as claimed in claim 1, wherein the supply voltage is an alternating voltage.

16. The operating device as claimed in claim 1, wherein the supply voltage switched by the control unit of the operating device timed to the bus (2) is supplied and rectified.

17. An illumination system, having a number of operating devices (3, 4, 5) for operating a light-emitting means (12), wherein the operating devices (3, 4, 5) are in each case connected to a bus line (2) via an interface (21), in each case have at least one supply terminal (16, 17) for connecting the operating device to a supply voltage provided by a supply source (20), and in each case at least one output terminal (10) for controlling the light-emitting means (12), at least one operating device (3) is connected to a sensor (11) via terminals (8, 9) and this operating device (3) has a transmission branch coupled to the interface (21), and a control unit of the operating device switches the supplied supply voltage timed to the bus line (2) in order to send data to a further operating device, wherein the data are coded to be analog or digital by the timing of the connection of the supply voltage.

18. The operating device as claimed in claim 17, wherein the supply voltage is an alternating voltage.

19. The operating device as claimed in claim 17, wherein the supply voltage switched by the control unit of the operating device timed to the bus (2) is supplied and rectified.

20. A method for transmitting data via a bus (2) on the basis of a first operating device for operating especially a light-emitting means (12) towards a second operating device, wherein the first operating device is supplied by a supply voltage, the first operating device switches the supplied supply voltage timed to the bus (2) via a transmission branch, in order to send the data to the second operating device, wherein the data are coded to be analog or digital by the timing of the connection of the supply voltage and the second operating device evaluates the supply voltage, connected to the bus (2), via a reception branch.

21. The method as claimed in claim 20, wherein the supply voltage switched by the first operating device timed to the bus (2) is supplied and rectified.

* * * * *